US009795982B2

(12) United States Patent
You

(10) Patent No.: US 9,795,982 B2
(45) Date of Patent: Oct. 24, 2017

(54) APPARATUS FOR DIPPING SUBSTRATE

(71) Applicant: Korea Research Institute of Standards and Science, Daejeon (KR)

(72) Inventor: Eun-Ah You, Daejeon (KR)

(73) Assignee: KOREA RESEARCH INSTITUTE OF STANDARDS AND SCIENCE, Daejeon (KR)

( * ) Notice: Subject to any disclaimer, the term of this patent is extended or adjusted under 35 U.S.C. 154(b) by 13 days.

(21) Appl. No.: 14/892,900

(22) PCT Filed: May 19, 2015

(86) PCT No.: PCT/KR2015/004992

§ 371 (c)(1),
(2) Date: Nov. 20, 2015

(87) PCT Pub. No.: WO2016/182107

PCT Pub. Date: Nov. 17, 2016

(65) Prior Publication Data

US 2017/0106394 A1 Apr. 20, 2017

(30) Foreign Application Priority Data

May 13, 2015 (KR) ..... 10-2015-0066418

(51) Int. Cl.
*B05C 3/00* (2006.01)
*B05C 3/02* (2006.01)
(Continued)

(52) U.S. Cl.
CPC ..... *B05C 3/02* (2013.01); *B05C 3/04* (2013.01); *B05C 13/02* (2013.01); *C25D 17/00* (2013.01)

(58) Field of Classification Search
USPC ..... 118/423, 429
See application file for complete search history.

(56) References Cited

U.S. PATENT DOCUMENTS 4,927,589 A * 5/1990 Egusa ..... B05C 3/02 118/402
6,774,021 B2 * 8/2004 Fukunaga ..... C25D 5/02 118/300
(Continued)

FOREIGN PATENT DOCUMENTS

EP 0857516 B2 8/1998
JP 58-159862 9/1983
(Continued)

OTHER PUBLICATIONS

N.J. Arfsten et al., "Investigations on the Angle-Dependent Dip Coating Technique (ADDC) for the Production of Optical Filters," Journal of Sol-Gel Science and Technology vol. 8, Kluwer Academic Publishers, Jan. 1997, pp. 1099-1104.
(Continued)

*Primary Examiner* — Yewebdar Tadesse
(74) *Attorney, Agent, or Firm* — Hauptman Ham, LLP

(57) ABSTRACT

An apparatus for dipping a substrate includes: a body having an internal plate formed therein, and including a backing plate provided over the internal plate; a crucible accommodating an aqueous solution therein and provided over the backing plate; a crucible driving unit provided in the body and connected to the crucible to move the crucible in a horizontal direction or a vertical direction of the body; a support having a lower end to which a substrate is fixed; a support driving unit provided to an upper side of the body and connected to the support to drive the support in a length direction of the support or rotate the support in the vertical direction of the body; and a controlling unit connected to the crucible driving unit and the support driving unit to control driving of the crucible driving unit and the support driving unit.

6 Claims, 11 Drawing Sheets

(51) Int. Cl.

| | |
|---|---|
| ***B05C 13/02*** | (2006.01) |
| ***B05C 3/04*** | (2006.01) |
| ***C25D 17/00*** | (2006.01) |

(56) References Cited

U.S. PATENT DOCUMENTS

| | | | | |
|---|---|---|---|---|
| 7,455,733 | B2 * | 11/2008 | Lee | B05D 7/22 118/423 |
| 2005/0158478 | A1 * | 7/2005 | Katsuoka | C23C 18/1619 427/437 |
| 2012/0104074 | A1 * | 5/2012 | Lyu | H01L 21/67144 228/8 |

FOREIGN PATENT DOCUMENTS

| | | | |
|---|---|---|---|
| JP | 05-208156 | A | 8/1993 |
| JP | 2008-718 | | 1/2008 |
| JP | 2008-2112825 | | 9/2008 |
| JP | 2011-31213 | | 2/2011 |
| KR | 10-0830173 | B1 | 5/2008 |
| KR | 10-2013-0009601 | A | 1/2013 |
| KR | 10-1401122 | B1 | 5/2014 |

OTHER PUBLICATIONS

International Search Report for corresponding International PCT Application No. PCT/KR2015/004992, dated Oct. 10, 2015.

* cited by examiner (a)

(b)

(a)

(b)

APPARATUS FOR DIPPING SUBSTRATE

TECHNICAL FIELD

The present invention relates to an apparatus for dipping a substrate, and more particularly, to an apparatus and method for dipping a substrate that fill materials such as nano-particles into a groove by controlling and dipping the substrate in which the groove is formed in a crucible in which an aqueous solution is accommodated at a predetermined angle or speed.

BACKGROUND ART

In general, a substrate is generally dipped in an aqueous solution in a vertical direction. Dipping refers to immersing or extracting the substrate in or from the aqueous solution.

The contents related to those described above are disclosed in Korean Patent No. 1401122 ("Apparatus and Method for Surface Treatment of Printed Circuit Board", registered on May 22, 2014).

The dipping method is used to apply the aqueous solution on a surface of the substrate. However, in the case in which the substrate in which a groove is formed in one surface thereof is dipped in the aqueous solution in the vertical direction, a case in which particles of the aqueous solution are not sufficiently filled in the groove occurs.

Further, even if the particles of the aqueous solution are filled in the groove, there is a disadvantage that a uniform quantity of particles is not filled in the groove.

In order to solve the above-mentioned disadvantage, an apparatus that may dip the substrate while maintaining a predetermined angle or may dip the substrate at a predetermined speed has recently been demanded.

RELATED ART DOCUMENT

Patent Document

Korean Patent No. 1401122 ("Apparatus and Method for Surface Treatment of Printed Circuit Board", registered on May 22, 2014)

DISCLOSURE

Technical Problem

An object of the present invention is to provide an apparatus for dipping a substrate that uniformly fills nano-particles in a groove of the substrate by dipping the substrate while maintaining a predetermined angle or speed with a surface of a solution, in order to uniformly fill the nano-particles in the groove of the substrate.

Technical Solution

In one general aspect, an apparatus for dipping a substrate includes: a body 100 having an internal plate 110 formed therein, and including a backing plate 120 provided over the internal plate 110; a crucible 200 accommodating an aqueous solution 210 therein and provided over the backing plate 120; a crucible driving unit 300 provided in the body 100 and connected to the crucible 200 so as to move the crucible 200 in a horizontal direction or a vertical direction of the body 100; a support 400 having a lower end to which a substrate 410 is fixed; a support driving unit 500 provided to an upper side of the body 100 and connected to the support 400 so as to drive the support 400 in a length direction of the support 400 or rotate the support 400 in the vertical direction of the body 100; and a controlling unit connected to the crucible driving unit 300 and the support driving unit 500 to control driving of the crucible driving unit 300 and the support driving unit 500.

The crucible driving unit 300 may include a horizontal driving unit 310 provided over the backing plate 120 and formed to drive the crucible 200 in the horizontal direction of the body 100; and a vertical driving unit 320 provided in the body 100 and formed to drive the backing plate 120 in the vertical direction of the body 100.

The horizontal driving unit 310 may include a plurality of first rails 311 provided over the backing plate 120 and formed to be parallel to each other in the horizontal direction of the body 100; and a crucible connecting means 312 having an upper portion on which the crucible 200 is provided and a lower portion connected to the first rail 311 so as to be moved in the horizontal direction of the body 100 along a path of the first rail 311.

The vertical driving unit 320 may include a second rail 321 having one side connected to the internal plate 110 and the other side connected to an upper portion of the body 100, and having a circumference surface connected to the backing plate 120; and a vertical driving means 322 provided between the internal plate 110 and the backing plate 120 and driven to move the backing plate 120 in the vertical direction of the body 100 along a path of the second rail 321.

The support driving unit 500 may include a support driving means 510 connected to the upper portion of the support 400 and formed to move the support 400 in a length direction of the support 400; and a rotating means 520 provided to the upper side of the body 100 and connected to the support driving means 510, so as to rotate the support 400 in the vertical direction of the body 100.

The support driving means 510 may include a rotating plate 511 having one surface connected to the rotating means 520 and rotated by the rotating means 520; a support driving motor 512 provided to be adjacent to the other surface of the rotating plate 511; a screw 513 having one side connected to the support driving motor 512 and the other side connected to the rotating plate 511 to be formed in the vertical direction of the body 100, and rotated by the support driving motor 512; a third rail 514 provided on the other surface of the rotating plate 511 and formed to be spaced apart from the screw 513 by a predetermined interval and to be parallel to the screw 513; and a support connecting means 515 having one side connected to the upper portion of the support 400 and the other side connected to the screw 513 and the third rail 514, and moving along a length direction of the screw 513 by a rotation of the third screw 512.

When the rotating means 520 rotates the support 400 formed in a lower direction of the body 100 in an upper direction of the body 100, the rotating means 520 may rotate the support 400 in a range of 0° to 50°.

When the substrate 410 is immersed in or extracted from the aqueous solution 210, the controlling unit may control the crucible driving unit 300 and the support driving unit 500 so that the substrate 410 maintains a predetermined angle on the basis of a surface of the aqueous solution 210.

When the substrate 410 is immersed in or extracted from the aqueous solution 210, the controlling unit may control the crucible driving unit 300 and the support driving unit 500 so that a predetermined speed is maintained.

Advantageous Effects

As described above, the present invention relates to the apparatus for dipping a substrate and has an effect in which the particles are uniformly filled in the groove formed in the substrate by dipping the substrate at the predetermined angle and speed with the solution.

BEST MODE

Hereinafter, a technical spirit of the present invention will be described in more detail with reference to the accompanying drawings.

The accompanying drawings are only examples shown in order to describe the technical spirit of the present invention in more detail. Therefore, the technical spirit of the present invention is not limited to figures in the accompanying drawings.

Figure 1:
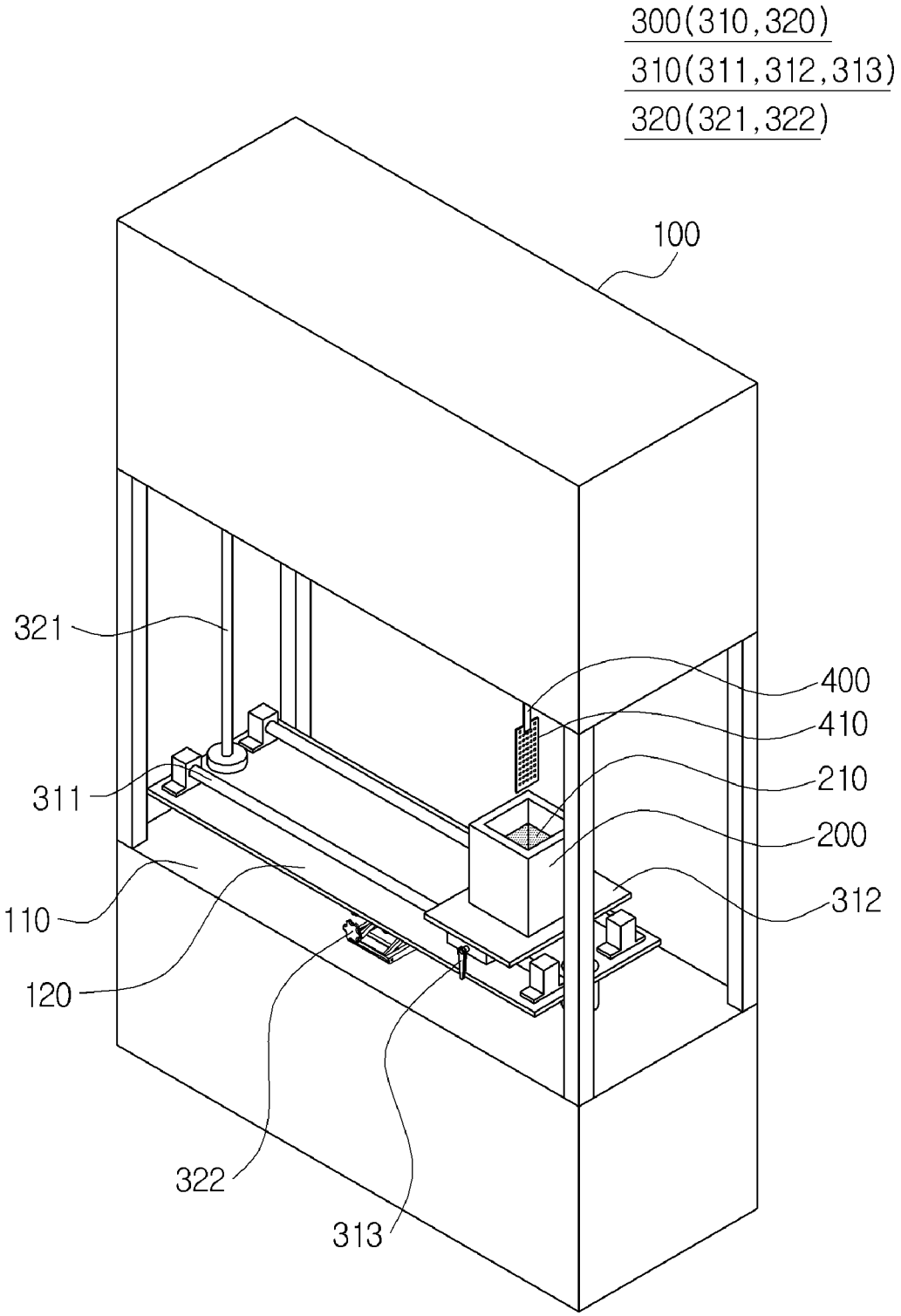
FIG. 1 is a perspective view illustrating an apparatus for dipping a substrate according to the present invention.
Figure 2:
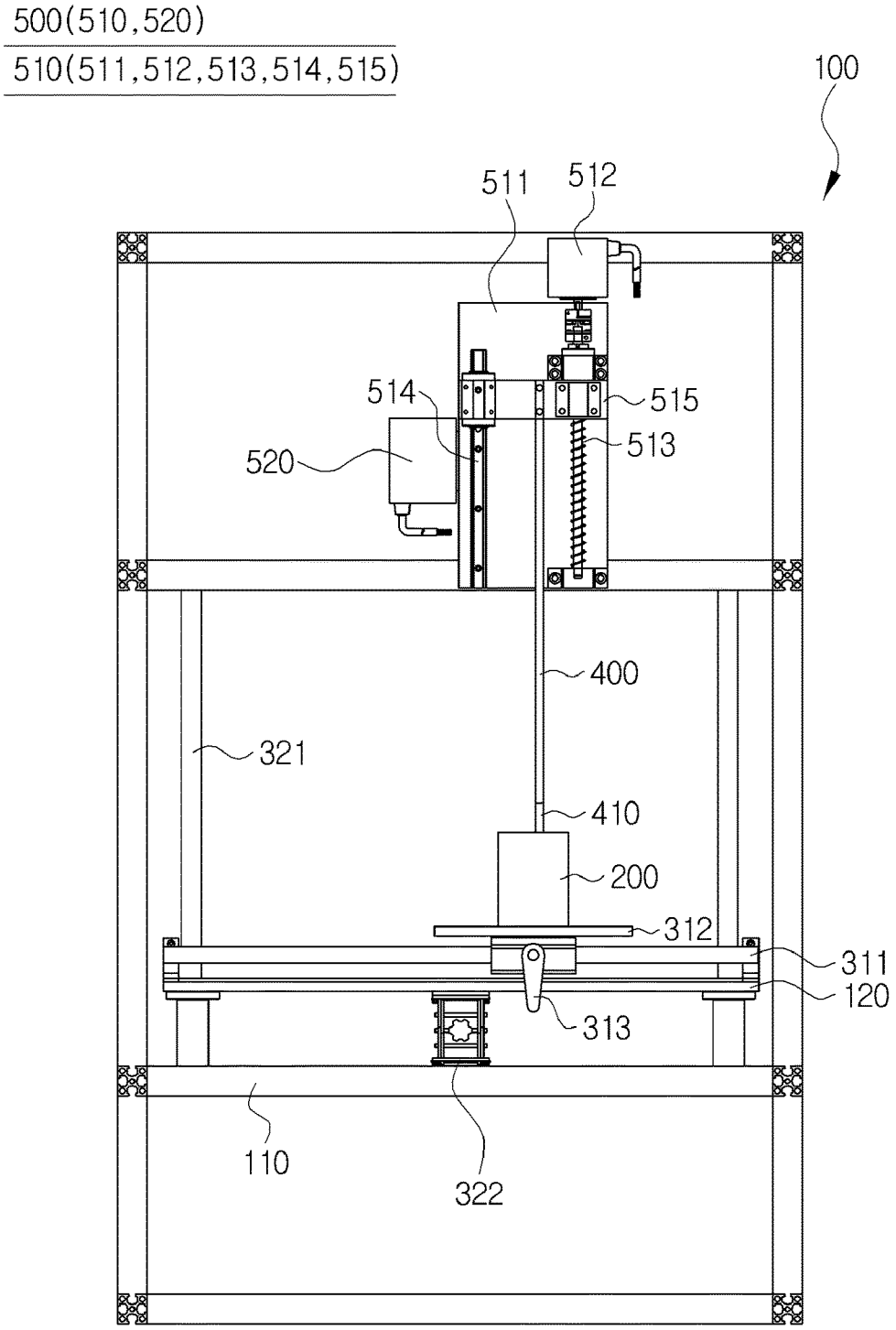
FIGS. 2 and 3 are internal cross-sectional views illustrating the apparatus for dipping a substrate according to the present invention.
Figure 3:
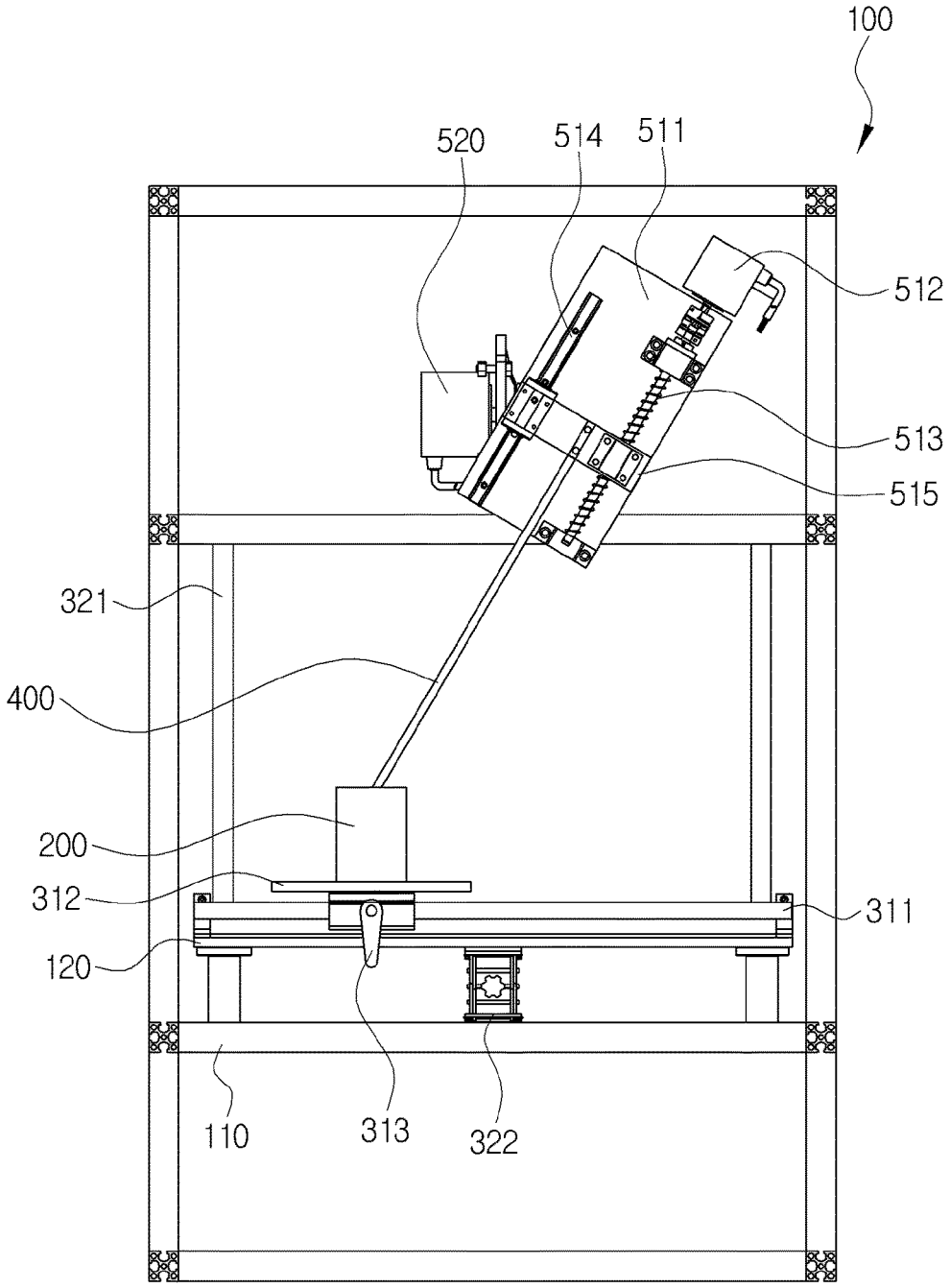
Figure 4:
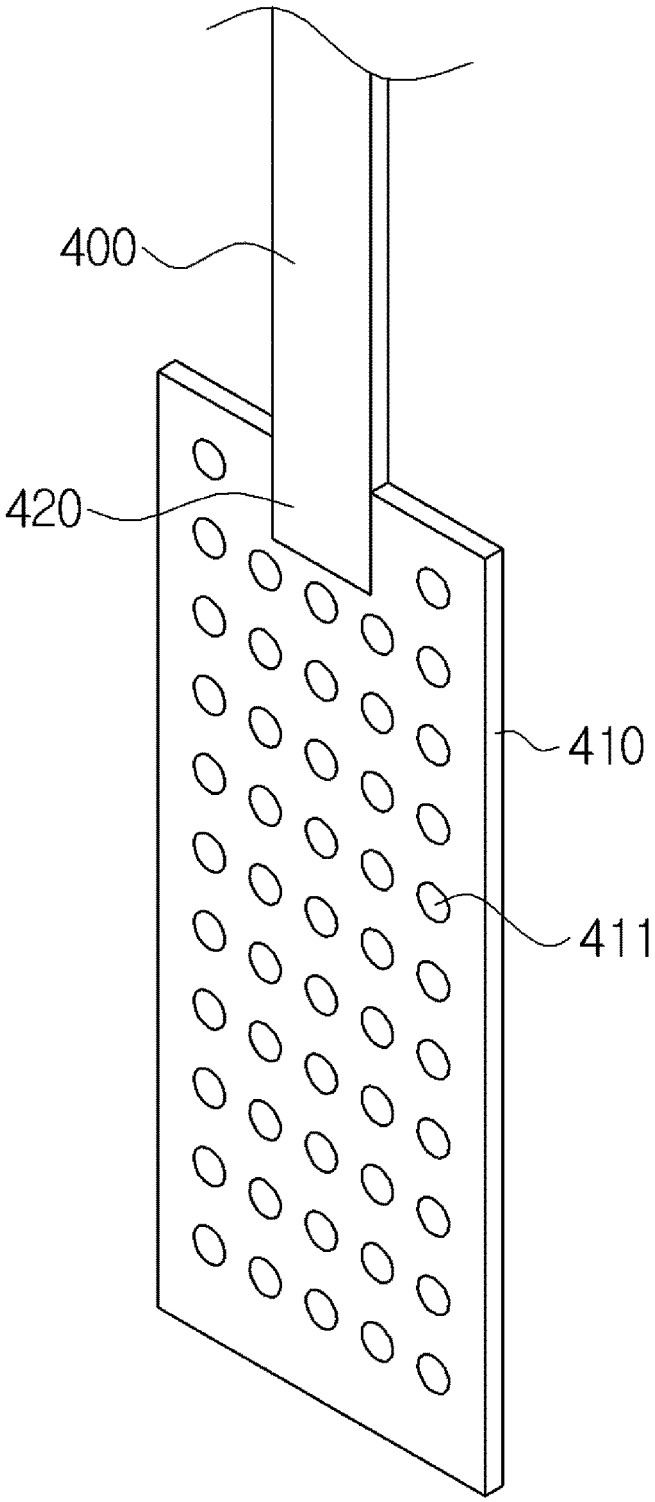
FIG. 4 is a perspective view illustrating the substrate according to the present invention.
Figure 5:
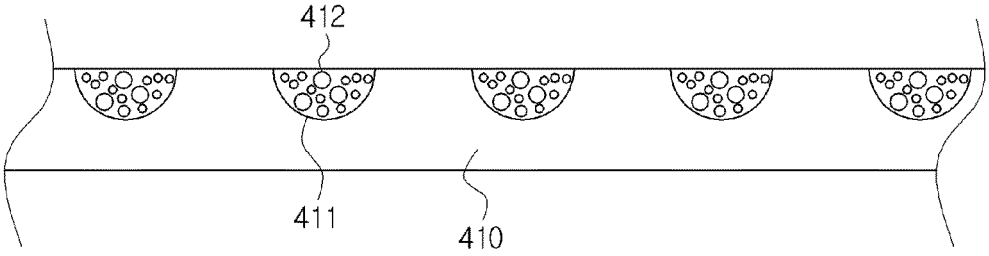
FIG. 5 is a cross-sectional view of the substrate according to the present invention.

FIG. 1 is a perspective view illustrating an apparatus for dipping a substrate according to the present invention and FIGS. 2 and 3 are internal cross-sectional views illustrating the apparatus for dipping a substrate according to the present invention. Further, FIG. 4 is a perspective view illustrating the substrate according to the present invention and FIG. 5 is a cross-sectional view of the substrate according to the present invention.

Referring to FIGS. 1 to 3, the present invention relates to an apparatus for dipping a substrate, which includes a body 100, a crucible 200, a crucible driving unit 300, a support 400, a support driving unit 500, and a controlling unit (not illustrated).

The body 100 has an internal plate 110 formed therein, and includes a backing plate 120 provided over the internal plate 110. Further, the crucible 200 is provided over the backing plate 120. Further, the crucible 200 accommodates an aqueous solution 210 therein.

The crucible driving unit 300 is provided in the body 100 and is connected to the crucible 200. The crucible driving unit 300 serves to move the crucible 200 in a horizontal direction or a vertical direction of the body 100. In more detail, the crucible driving unit 300 includes a horizontal driving unit 310 and a vertical driving unit 320.

The horizontal driving unit 310 is provided over the backing plate 120 to be connected to the crucible 200, and is formed to drive the crucible 200 in a horizontal direction of the body 100. Further, the horizontal driving unit 310 is manually driven and is automatically driven using various apparatuses. Examples in which the horizontal driving unit 310 is automatically driven will be described. The horizontal driving unit 310 is driven by a configuration of a motor and a screw, and is driven by apparatuses such as a pneumatic cylinder and a hydraulic cylinder.

Thus, the horizontal driving unit 310 is connected to the crucible 200, so as to be variously used as an apparatus and a configuration that move the crucible 200 in the horizontal direction of the body 100.

The vertical driving unit 320 is provided in the body 100 to be connected to the backing plate 120, and serves to drive the backing plate 120 in a vertical direction of the body 100. Further, the vertical driving unit 310 is also manually driven and is also automatically driven using various apparatuses, in the same way as the horizontal driving unit 310. Examples in which the vertical driving unit 320 is automatically driven will be described. The vertical driving unit 320 is driven by a configuration of a motor and a screw, and is driven by apparatuses such as a pneumatic cylinder and a hydraulic cylinder.

Thus, the vertical driving unit 320 is connected to the backing plate 120, so as to be variously used as an apparatus and a configuration that vertically move the backing plate 120 in the vertical direction of the body 100.

An upper side of the body 100 is provided with the support 400 and the support driving unit 500. In more detail, the support driving unit 500 is provided to the upper side of the body 100, and the support 400 is connected to the support driving unit 500 so as to be rotated.

As illustrated in FIGS. 2 to 4, an upper portion of the support 400 is connected to the support driving unit 500, and a lower end thereof is provided with a substrate connecting unit 420 that fixes the substrate 410. The substrate connecting unit 420 may be variously used as fix pincers, a hook that may hook the substrate 410, and the like.

As illustrated in FIGS. 2 and 3, the support driving unit 500 is provided to the upper side of the body 100 and is connected to the support 400. Further, the support driving unit 500 serves to move the support 400 in a length direction of the support 400 or rotate the support 400 in the vertical direction of the body 100. In more detail, the support driving unit 500 includes a support driving means 510 and a rotating means 520.

The support driving means 510 is connected to the upper portion of the support 400 and serves to drive the support 400 in the length direction of the support 400. The support driving means 510 is driven by a configuration of a motor and a screw, and is driven by apparatuses such as a pneumatic cylinder and a hydraulic cylinder.

Thus, the support driving means 510 is connected to the support 400, so as to be variously used as an apparatus and a configuration that move the support 400 in the length direction of the support 400.

The rotating means 520 serves to move the support 400 provided in the support driving means 510 in the vertical direction of the body 100. In more detail, the rotating means 520 is provided to the upper side of the body 100 and is connected to the support driving means 510. The rotating means 520 rotates the support 400 provided in the support driving means 510 in the vertical direction of the body 100. That is, the rotating means 520 rotates the support 400 to allow the substrate 410 provided to an end of the support 400 to be formed at a predetermined angle with a surface of the aqueous solution 210. As described above, if the substrate 410 is formed at the predetermined angle with the surface of the aqueous solution 210, the vertical driving unit 320 or the support driving means 510 is driven to immerse or extract the substrate 410 in or from the aqueous solution 210.

Further, when the rotating means 520 rotates the support 400 formed in a lower direction of the body 100 in an upper direction of the body 100, the rotating means 520 rotates the support 400 in a range of 0° to 50°.

The controlling unit is connected to the crucible driving unit 300 and the support driving unit 500 and serves to control the crucible driving unit 300 and the support driving unit 500. In more detail, when the substrate 410 is immersed in or extracted from the aqueous solution 210, the controlling unit controls the crucible driving unit 300 and the support driving unit 500 so that the substrate 410 maintains a predetermined angle on the basis of the surface of the aqueous solution 210. Further, when the substrate 410 is immersed in or extracted from the aqueous solution 210, the controlling unit controls the crucible driving unit 300 and the support driving unit 500 so that a predetermined speed is maintained.

Thus, the present invention is to immerse or extract (dip) the substrate 410 in or from the aqueous solution 210 at the predetermined speed by allowing the substrate 410 to be maintained at the predetermined angle with the surface of the aqueous solution 210. As described above, in the case in which the substrate 410 is dipped in the aqueous solution 210, there is an effect that particles of the aqueous solution 210 may be uniformly filled in a groove formed in the substrate 410.

EXEMPLARY EMBODIMENTS

An exemplary embodiment of the apparatus for dipping a substrate according to the present invention will be described in detail.

Referring to FIGS. 1 to 3, the apparatus for dipping a substrate according to an exemplary embodiment of the present invention includes a body 100, a crucible 200, a crucible driving unit 300, a support 400, a support driving unit 500, and a controlling unit (not illustrated).

The body 100 has an internal plate 110 formed therein, and a backing plate 120 is provided over the internal plate 110. Further, the crucible 200 is provided over the backing plate 120. Further, the crucible 200 accommodates an aqueous solution 210 therein.

The crucible driving unit 300 serves to move the crucible 200 in a horizontal direction or a vertical direction of the body 100. In more detail, the crucible driving unit 300 includes a horizontal driving unit 310 and a vertical driving unit 320.

Figure 6:
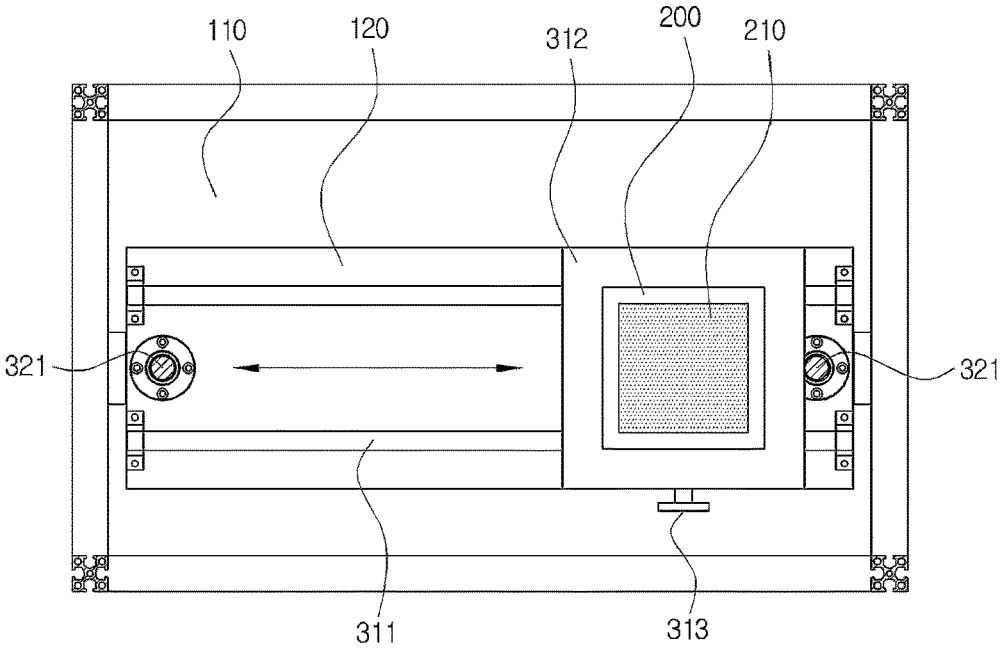
FIG. 6 is a plan view illustrating a crucible driving unit of an apparatus for dipping a substrate according to the present invention.
Figure 7:
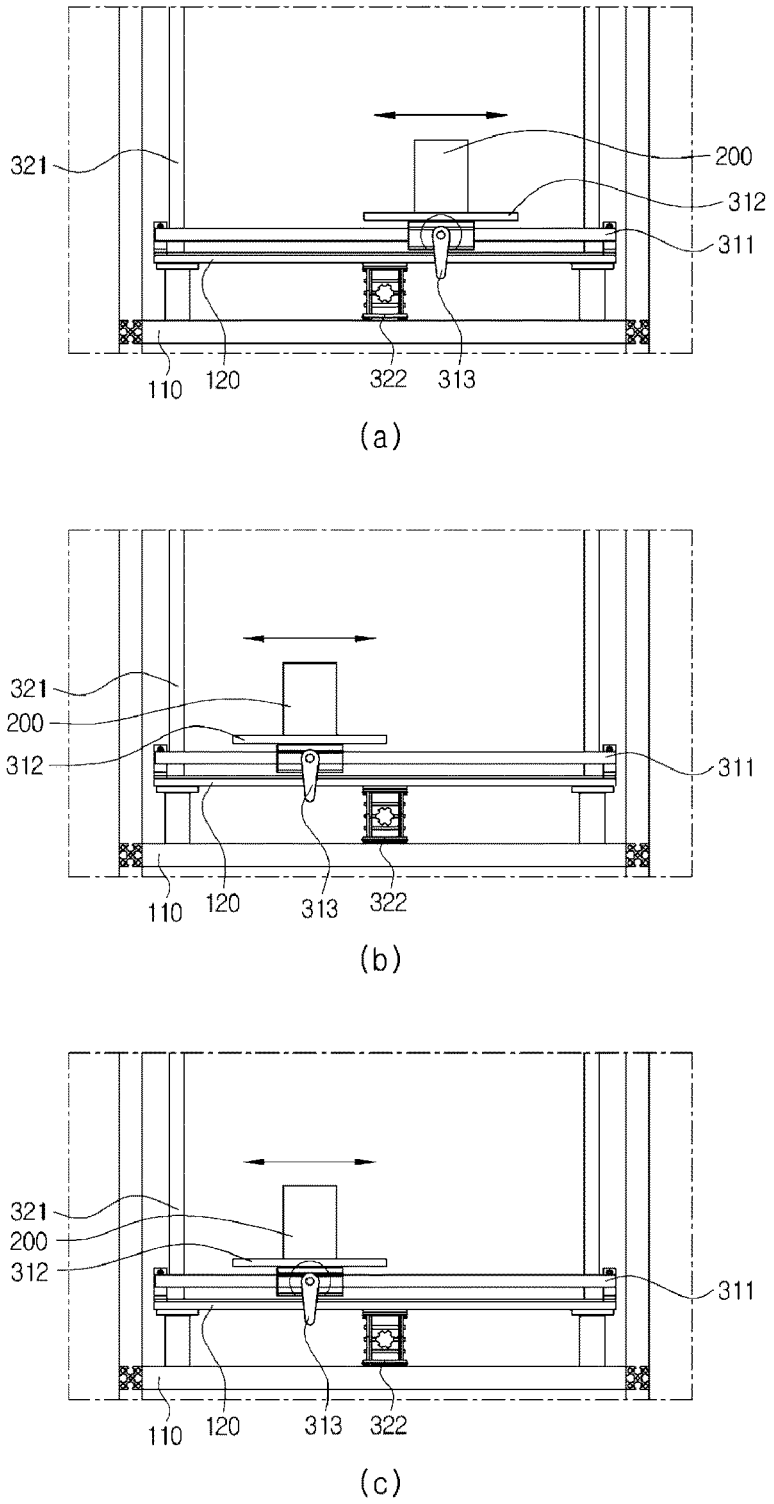
FIG. 7 is an exemplary embodiment illustrating a driving of the crucible driving unit of the apparatus for dipping a substrate according to the present invention.
Figure 8:
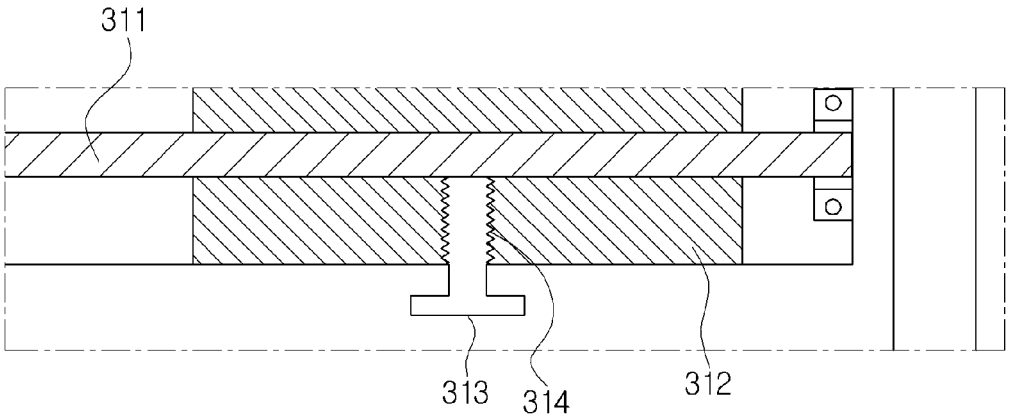
FIG. 8 is an exemplary embodiment in which the crucible driving unit according to the present invention is fixed.

FIG. 6 is a plan view illustrating a crucible driving unit of an apparatus for dipping a substrate according to the present invention, FIG. 7 is an exemplary embodiment illustrating a driving of the crucible driving unit of the apparatus for dipping a substrate according to the present invention, and FIG. 8 is an exemplary embodiment in which the crucible driving unit according to the present invention is fixed.

Referring to FIGS. 6 to 8, the horizontal driving unit 310 is provided over the backing plate 120 to be connected to the crucible 200, and serves to drive the crucible 200 in a horizontal direction of the body 100. In more detail, the horizontal driving unit 310 includes a first rail 311 and a crucible connecting means 312.

A plurality of first rails 311 are provided over the backing plate 120 and are formed to be parallel to each other in the horizontal direction of the body 100.

The crucible connecting means 312 has an upper portion on which the crucible 200 is provided and a lower portion to which the first rail 311 is connected. The crucible connecting means 312 is moved in the horizontal direction of the body 100 along a path of the first rail 311, as illustrated in FIGS. 7A and 7B.

As illustrated in FIG. 8, the crucible connecting means 312 further includes a fixing unit formed at a lower end thereof to be fixed to the first rail 311. The fixing unit includes a fixing handle 313 and a fixing screw 314. In more detail, when the fixing handle 313 of the fixing unit is rotated, the fixing screw 314 is closely adhered to the first rail 311 to fix the crucible connecting means 312, or the fixing screw 314 is spaced apart from the first rail 311 to allow the crucible connecting means 312 to be moved.

The horizontal driving unit 310 having the above-mentioned configuration is a configuration which is manually driven. However, the configuration of the horizontal driving unit 310 is only an exemplary embodiment, and may also be automatically driven by including another apparatus.

Figure 9:
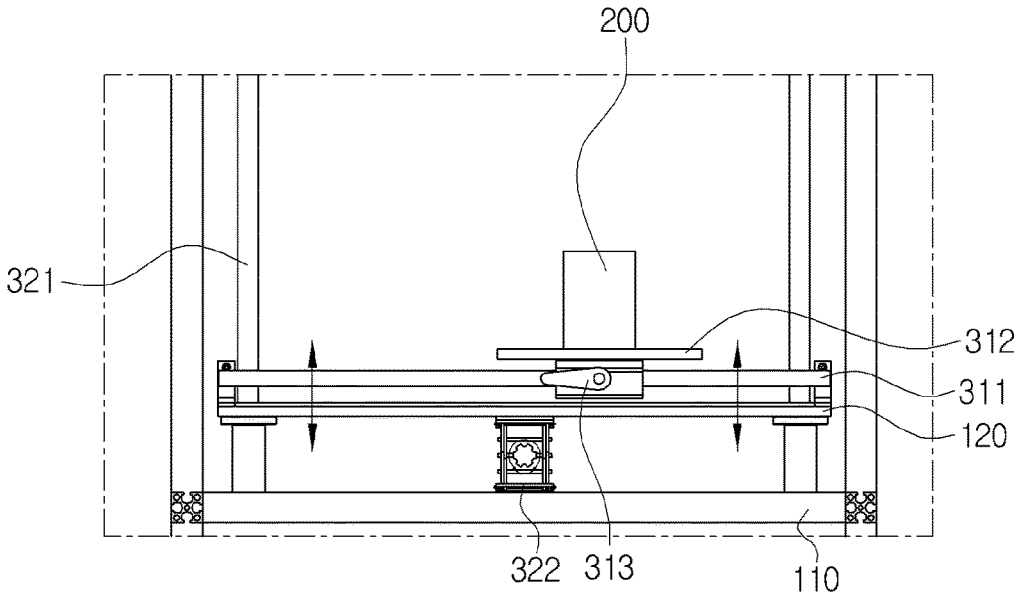
FIG. 9 is an exemplary embodiment illustrating a driving of a vertical driving unit of the apparatus for dipping a substrate according to the present invention.
Figure 9:
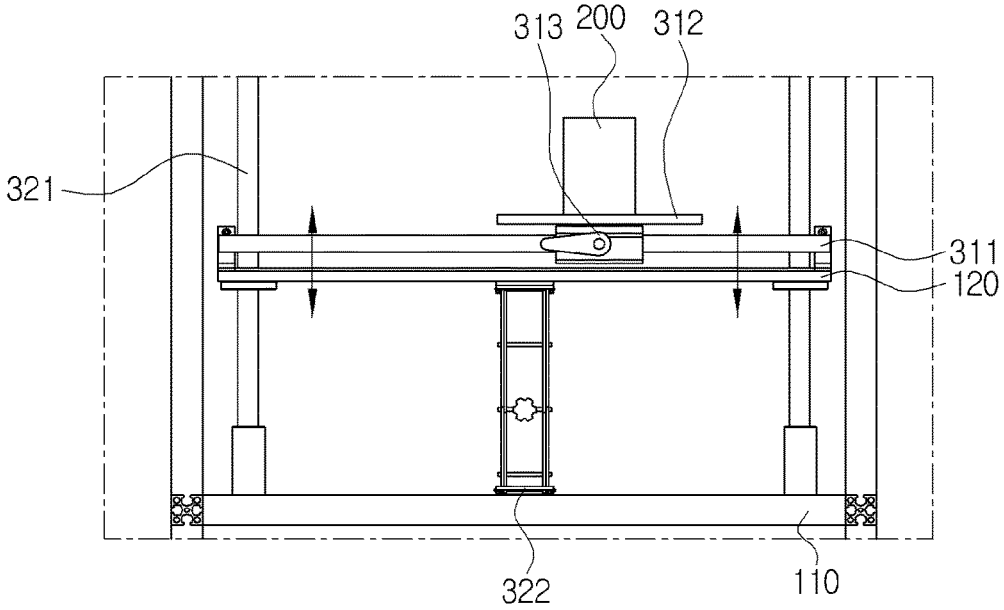

FIG. 9 is an exemplary embodiment illustrating a driving of a vertical driving unit of the apparatus for dipping a substrate according to the present invention.

As illustrated in FIG. 9, the vertical driving unit 320 is provided in the body 100 to be connected to the backing plate 120, and serves to drive the backing plate 120 in a vertical direction of the body 100. In more detail, the vertical driving unit 320 includes a second rail 321 and a vertical driving means 322.

The second rail 321 has one side connected to the internal plate 110 and the other side connected to an upper portion of the body 100. Further, a circumference surface of the second rail 321 is connected to the backing plate 120.

The vertical driving unit 322 is provided between the internal plate 110 and the backing plate 120, and is driven to move the backing plate 120 in the vertical direction of the body 100 along a path of the second rail 321. For example, the vertical driving means 322 may be an apparatus such as a vehicle jockey, or may be used by applying apparatuses such as a pneumatic cylinder and a hydraulic cylinder.

The vertical driving unit 320 having the above-mentioned configuration is a configuration which is manually driven. However, the configuration of the vertical driving unit 320 is only an exemplary embodiment, and may also be automatically driven by including another apparatus.

Figure 10:
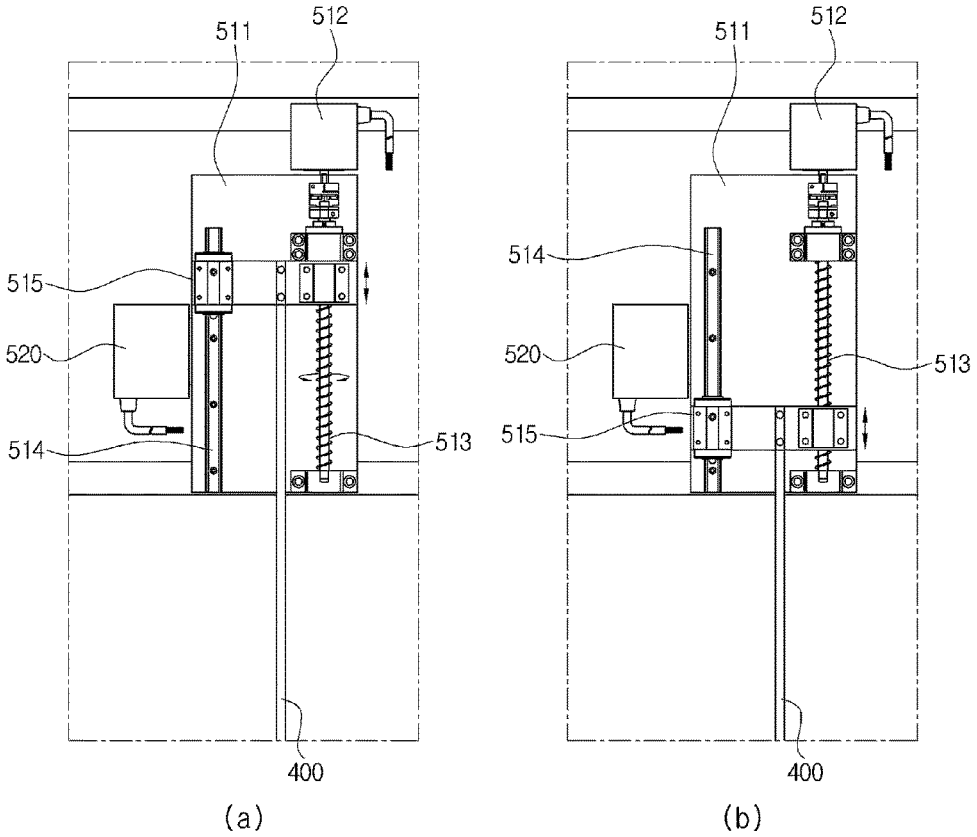
FIG. 10 is an exemplary embodiment illustrating a driving of a support driving means of the apparatus for dipping a substrate according to the present invention.
Figure 11:
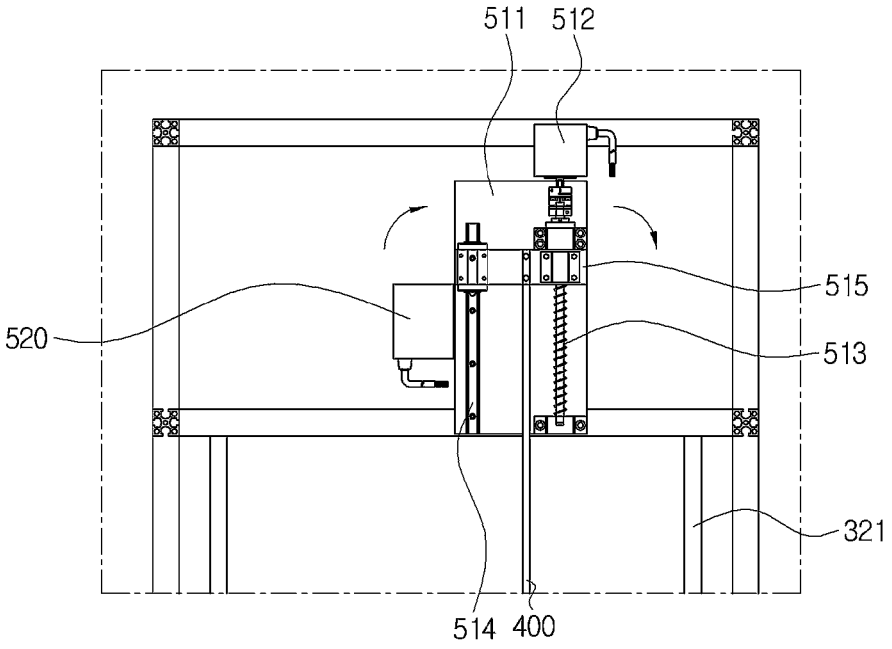
FIG. 11 is an exemplary embodiment illustrating a driving of a rotating means of the apparatus for dipping a substrate according to the present invention.
Figure 11:
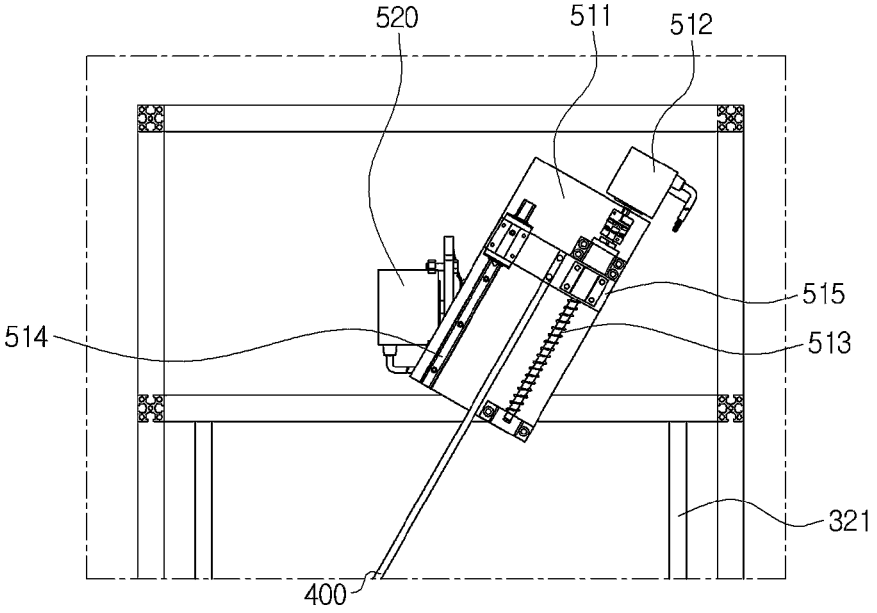

FIG. 10 is an exemplary embodiment illustrating a driving of a support driving means of the apparatus for dipping a substrate according to the present invention and FIG. 11 is an exemplary embodiment illustrating a driving of a rotating means of the apparatus for dipping a substrate according to the present invention.

An upper side of the body 100 is provided with the support 400 and the support driving unit 500. In more detail, the support driving unit 500 is provided to the upper side of the body 100, and the support 400 is connected to the support driving unit 500 so as to be rotated.

As illustrated in FIG. 4, an upper portion of the support 400 is connected to the support driving unit 500, and a lower end thereof is provided with a substrate connecting unit 420 that fixes the substrate 410. The substrate connecting unit 420 may be variously used as fix pincers, a hook that may hook the substrate 410, and the like.

The support driving unit 500 is provided to the upper side of the body 100 and is connected to the support 400. Further, the support driving unit 500 serves to move the support 400 in a length direction of the support 400 or rotate the support 400 in the vertical direction of the body 100. In more detail, the support driving unit 500 includes a support driving means 510 and a rotating means 520.

As illustrated in FIGS. 10A and 10B, the support driving means 510 is connected to the upper portion of the support 400 and serves to drive the support 400 in the length direction of the support 400. In more detail, the support driving unit 511 is configured to include a rotating plate 511, a support driving motor 512, a screw 513, a third rail 514, and a support connecting means 515.

One surface of the rotating plate 511 is connected to the rotating means 520 so as to be rotated by the rotating means 520. Further, the other surface of the rotating plate 511 is provided with the support driving motor 512, the screw 513, the third rail 514, and the support connecting means 515.

The support driving motor 512 is provided to be adjacent to the other surface of the rotating plate 511.

One side of the screw 513 is connected to the support driving motor 512, and the other side thereof is connected to the rotating plate 511. Further, the screw 513 is provided to be formed in the vertical direction of the body 100. Further, the screw 513 has a screw thread formed in an outer side thereof and is rotated by the support driving motor 512.

The third rail 514 is provided on the other surface of the rotating plate 511 and is formed to be spaced apart from the screw 513 by a predetermined interval and to be parallel to the screw 513. That is, the third rail 514 is spaced apart from the screw 513 by the predetermined interval and is formed to be parallel to the screw 513 so as to be formed in the vertical direction of the body 100.

The support connecting means 515 has one side connected to the upper portion of the support 400 and the other side connected to the screw 513 and the third rail 514. In this case, the support connecting means 515 is connected to the support 400, and the screw 513 and third rail 514 so that a length of the support 400 forms the vertical direction of the body 100. The support connecting means 515 moves the support 400 in a length direction of the support 400 by a rotation of the screw 513.

As illustrated in FIGS. 11A and 11B, the rotating means 520 serves to rotate the support 400 provided in the support driving means 510 in the vertical direction of the body 100. In more detail, one side of the rotating means 520 is provided to the upper side of the body 100 and the other side thereof is connected to the support driving means 510. Further, the rotating plate 511 is provided between the rotating means 520 and the support driving means 510. The rotating means 520 having the above-mentioned configuration rotates the support 400 provided in the support driving means 510 in the vertical direction of the body 100. That is, the rotating means 520 rotates the support 400 to allow the substrate 410 provided to an end of the support 400 to be formed at a predetermined angle with a surface of the aqueous solution 210. In this case, if the substrate 410 is formed at the predetermined angle with the surface of the aqueous solution 210, the vertical driving unit 320 or the support driving means 510 is driven to immerse or extract the substrate 410 in or from the aqueous solution 210.

Further, when the rotating means 520 rotates the support 400 formed in a lower direction of the body 100 in an upper direction of the body 100, the rotating means 520 rotates the support 400 in a range of 0° to 50°.

Figure 12:
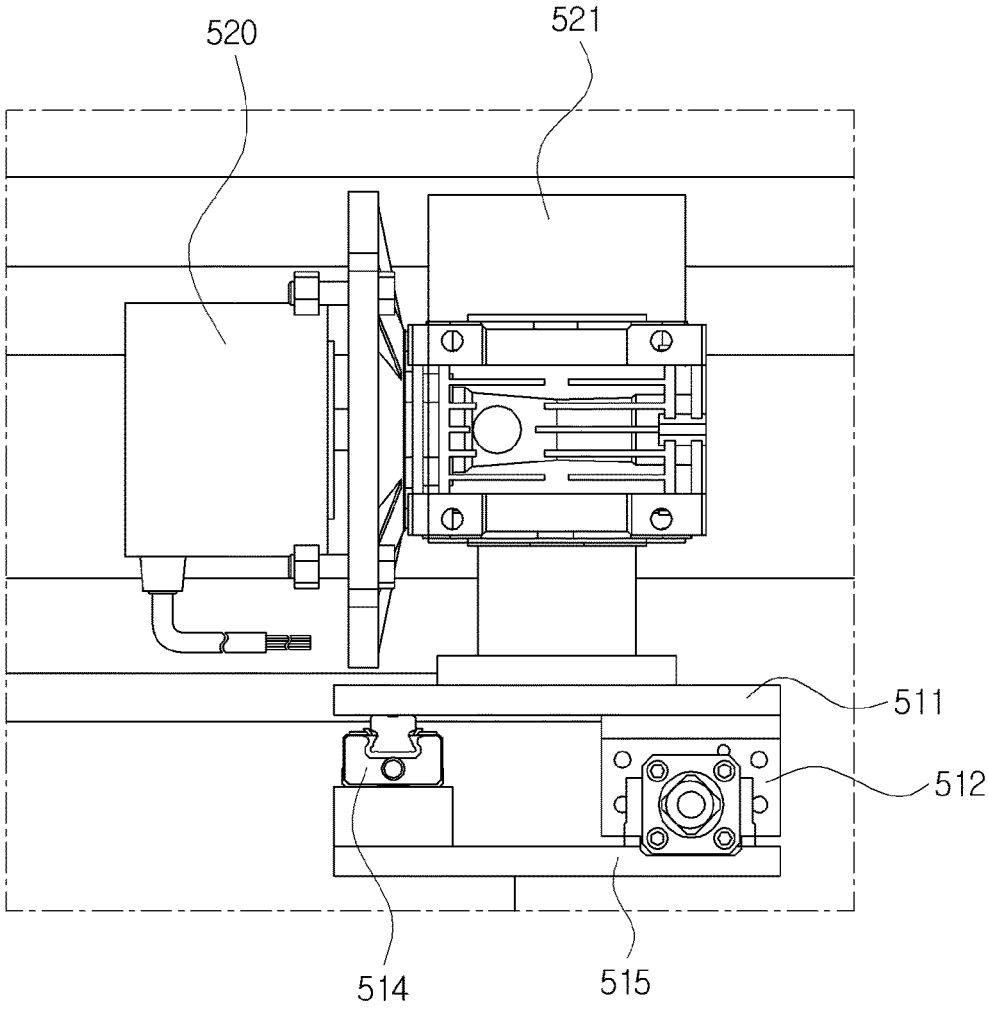
FIG. 12 is a plan view illustrating a configuration of the rotating means of the apparatus for dipping a substrate according to the present invention.

FIG. 12 is a plan view illustrating a configuration of the rotating means of the apparatus for dipping a substrate according to the present invention.

As illustrated in FIG. 12, the rotating means 520 further includes a decelerator 521. The decelerator 521 is provided between the rotating means 520 and the support driving means 510. The decelerator 521 controls a rotation speed of the rotating means 520 to rotate the support driving means 510.

The controlling unit is connected to the crucible driving unit 300 and the support driving unit 500 and serves to control the crucible driving unit 300 and the support driving unit 500. In more detail, when the substrate 410 is immersed in or extracted from the aqueous solution 210, the controlling unit controls the crucible driving unit 300 and the support driving unit 500 so that the substrate 410 maintains a predetermined angle on the basis of the surface of the aqueous solution 210. Further, when the substrate 410 is immersed in or extracted from the aqueous solution 210, the controlling unit controls the crucible driving unit 300 and the support driving unit 500 so that a predetermined speed is maintained.

DETAILED DESCRIPTION OF MAIN ELEMENTS

100: body
110: internal plate
120: backing plate
200: crucible
210: aqueous solution
300: crucible driving unit
310: horizontal driving unit
311: first rail
312: crucible connecting means
313: fixing handle
314: fixing screw
320: vertical driving unit
321: second rail
322: vertical driving means
400: support
410: substrate
411: groove
412: particle
420: substrate connecting unit
500: support driving unit
510: support driving means
511: rotating plate
512: support driving motor
513: screw
514: third rail
515: support connecting means
520: rotating means

The invention claimed is:

1. An apparatus for dipping a substrate, comprising:

a body having an internal plate formed therein, and including a backing plate provided over the internal plate;

a crucible accommodating an aqueous solution therein and provided over the backing plate;

a crucible driving unit provided in the body and connected to the crucible so as to move the crucible in a horizontal direction or a vertical direction of the body;

a support having a lower end to which a substrate is fixed;

a support driving means connected to an upper portion of the support and configured to move the support in a length direction of the support;

a rotating means provided to an upper side of the body and connected to the support driving means to rotate the support in the vertical direction of the body;

a controlling unit connected to the crucible driving unit, the support driving means, and the rotating means to control driving of the crucible driving unit, the support driving means, and the rotating means, wherein the crucible driving unit includes:

a horizontal driving unit provided over the backing plate and formed to drive the crucible in the horizontal direction of the body; and a vertical driving unit provided in the body and formed to drive the backing plate in the vertical direction of the body, wherein the horizontal driving unit includes:

a plurality of first rails provided over the backing plate and formed to be parallel to each other in the horizontal direction of the body; and a crucible connecting means having an upper portion on which the crucible is provided and a lower portion connected to one of the first rails, so as to be moved in the horizontal direction of the body along a path of said one of the first rails, and wherein the vertical driving unit includes:

a second rail having one side connected to the internal plate and the other side connected to an upper portion of the body, and having a circumference surface connected to the backing plate; and a vertical driving means provided between the internal plate and the backing plate and driven to move the backing plate in the vertical direction of the body along a path of the second rail.

2. The apparatus of claim 1, wherein the support driving means includes a rotating plate having one surface connected to the rotating means, wherein said rotating plate is configured to be rotated by the rotating means;

a support driving motor provided to be adjacent to another surface of the rotating plate;

a screw having one side connected to the support driving motor and another side connected to the rotating plate, wherein said screw is formed in the vertical direction of the body and configured to be rotated by the support driving motor;

a third rail provided on said another surface of the rotating plate, spaced apart from the screw by a predetermined interval, and to be parallel to the screw; and a support connecting means having one side connected to the upper portion of the support and another side connected to the screw and the third rail, wherein said support connecting means is configured to move along a length direction of the screw by a rotation of the screw.

3. The apparatus of claim 1, wherein the rotating means is configured to rotate the supporter formed in a lower direction of the body in an upper direction of the body in a range of 0° to 50°.

4. The apparatus of claim 1, wherein the controlling unit is configured to control the crucible driving unit, the support driving means, and the rotating means, to cause the substrate to maintain a predetermined angle on the basis of a surface of the aqueous solution when the substrate is immersed in or extracted from the aqueous solution.

5. The apparatus of claim 1, wherein the controlling unit is configured to control the crucible driving unit, the support driving means, and the rotating means to maintain a predetermined speed when the substrate is immersed in or extracted from the aqueous solution.

6. An apparatus for dipping a substrate, comprising:

a body having an internal plate formed therein, and including a backing plate provided over the internal plate;

a crucible accommodating an aqueous solution therein and provided over the backing plate;

a crucible driving unit provided in the body and connected to the crucible so as to move the crucible in a horizontal direction or a vertical direction of the body;

a support having a lower end to which a substrate is fixed;

a support driving device connected to an upper portion of the support and configured to move the support in a length direction of the support;

a rotating device provided to an upper side of the body and connected to the support driving device to rotate the support in the vertical direction of the body;

a controlling unit connected to the crucible driving unit, the support driving device, and the rotating device to control driving of the crucible driving unit, the support driving device, and the rotating device, wherein the crucible driving unit includes:

a horizontal driving unit provided over the backing plate and formed to drive the crucible in the horizontal direction of the body; and a vertical driving unit provided in the body and formed to drive the backing plate in the vertical direction of the body, wherein the horizontal driving unit includes:

a plurality of first rails provided over the backing plate and formed to be parallel to each other in the horizontal direction of the body; and a crucible connecting member having an upper portion on which the crucible is provided and a lower portion connected to one of the first rails, so as to be moved in the horizontal direction of the body along a path of said one of the first rails, and wherein the vertical driving unit includes:

a second rail having one side connected to the internal plate and the other side connected to an upper portion of the body, and having a circumference surface connected to the backing plate; and a vertical driving device provided between the internal plate and the backing plate and driven to move the backing plate in the vertical direction of the body along a path of the second rail.

* * * * *